United States Patent [19]

Nishikawa et al.

[11] Patent Number: 4,755,647

[45] Date of Patent: Jul. 5, 1988

[54] CONTROL UNIT FOR POWER-SUPPLY CIRCUIT IN ELECTRONIC RANGE

[75] Inventors: Hideo Nishikawa; Kenzo Okamoto, both of Osaka; Fumihiko Kitada, Neyagawa, all of Japan

[73] Assignee: Imanishi Kinzoku Kogyo Kabushiki Kaisha, Osaka, Japan

[21] Appl. No.: 855,294

[22] Filed: Apr. 24, 1986

[30] Foreign Application Priority Data

Apr. 27, 1985 [JP] Japan ..... 60-091881

[51] Int. Cl.[4] ..... H05B 6/76

[52] U.S. Cl. ..... 219/10.55 C; 219/10.55 B; 126/197; 200/61.62; 200/50 C

[58] Field of Search ..... 219/10.55 B, 10.55 C; 200/50 A, 50 B, 50 C, 61.62-61.64; 126/197

[56] References Cited

U.S. PATENT DOCUMENTS

| | | | |
|---|---|---|---|
| 3,865,097 | 2/1975 | Robinson | 126/197 |
| 4,006,121 | 2/1977 | Isono | 219/10.55 C |
| 4,101,750 | 7/1978 | Donor | 219/10.55 C |
| 4,511,780 | 4/1985 | Okamura | 126/197 |
| 4,516,007 | 5/1985 | Ringdahl et at. | 219/10.55 C |
| 4,542,269 | 9/1985 | Sakoda | 219/10.55 C |

*Primary Examiner*—M. H. Paschall

*Attorney, Agent, or Firm*—Armstrong, Nikaido, Marmelstein & Kubovcik

[57] ABSTRACT

In an electronic range, an opening/closing operation of a range door thereof is manually conducted while switching operation of a power-supply circuit is conducted through a push-button type starting switch to make it possible that a control unit for the power-supply circuit is not energized when the range door is open, so that a control switch of the electronic range is completely prevented from being misused.

2 Claims, 8 Drawing Sheets

CONTROL UNIT FOR POWER-SUPPLY CIRCUIT IN ELECTRONIC RANGE

BACKGROUND OF THE INVENTION

1. Field of the Invention

The present invention relates to an electronic range provided with a novel control unit for a power-supply circuit thereof, and more particularly to an electronic range in which an opening/closing operation of a range door is manually conducted while switching operation of the power-supply circuit is conducted through a push-button type starting switch to make it possible that the control unit for the power-supply circuit is not energized when the range door is open, so that a control switch of the electronic range is completely prevented from being misused.

2. Description of the Prior Art

Hitherto, in most electronic ranges, the range door is manually closed while opened mechanically by pushing the push-button after completion of cooking in the range for taking out the thus cooked food. The Power-supply of the range is cut off at the same time when the range door is opened. Once the power-supply is cut off, the range is not energized until the range door is closed again. Further, even when the power-supply circuit of the range is energized, oscillation of microwave in the range is prevented from occurring by means of a safety mechanism employed in the range unitl it is confirmed that such oscillation does not affect the user.

However, in such conventional electronic ranges, a door switch for opening the range door and another switch for controlling the power-supply circuit of the range are separately provided from each other to operate independently. Consequently, hitherto, these switches are often misused by the user to cause accidents.

SUMMARY OF THE INVENTION

It is an object of the present invention to provide an electronic range characterized by manually conducting an opening/closing operation of a range door thereof and provided with a power-supply circuit control unit comprising:

a pair of interlocked hook means which are provided inside a range door;

a pair of a first and a second power-supply circuit control mechanisms associated with the hook means in action corresponding to an opening/closing operation of the range door, and actuated by the hook means, one of which mechanisms engages with one of the hook means to conduct a direct opening/closing operation of its circuit, and the other of which mechanisms engages indirectly with the other of the hook means through a swinging means to conduct an opening/closing operation of its circuit;

a swingable operation means associated with both the swinging means and a third power-supply circuit control mechanism, and provided with an arm in its upper end and an engaging portion in its lower end, which arm engages with a free end of the swinging means in a detachable manner, and which engaging portion engages with a portion of the third power-supply circuit control mechanism; and the third power-supply circuit control mechanism associated with the swingable operation means so as to be capable of being energized when it is manually operated.

It is another object of the present invention to provide an electronic range provided with a power-supply circuit control unit in which the swinging means is permitted its gravitational return to its initial position where it is still not engaging with the hook means, when it is disengaged from the hook means.

It is further another object of the present invention to provide an electronic range provided with a power-supply circuit control unit in which the swingable operation means is urged in a predetermined direction under the influence of a resilient force of a coil spring so as to return a position in which the third power-supply circuit control mechanism is locked.

It is still further another object of the present invention to provide an electronic range provided with a power-supply circuit control unit in which: the third power-supply circuit control mechanism comprises a frame mounted on an inner surface of a switch panel fitted to a front surface of a heating cage, a sliding plate slidably inserted in sliding grooves formed in a pair of upright tabs of the frame, and a movable plate pivotally mounted on the frame; and the sliding plate is slidably moved through a push-button which is inserted in the switch panel in a projectable/retractable manner to make it possible that the sliding plate engages at a notch groove formed in its bent tab with an engaging tab provided in the movable plate in a projecting manner, while the sliding plate abuts, at its end opposite to its another end abutting against the push-button, against a microswitch provided in the third power-supply circuit control mechanism to operate the same.

It is another object of the present invention to provide an electronic range provided with a power-supply circuit control unit in which the third power-supply circuit control mechanism, while it keeps its circuit closed, restricts a return movement of the sliding plate at a time when the push-button is operated in a pushing manner.

It is further another object of the presen invention to provide an electronic range provided with a power-supply circuit control unit in which a coil spring is mounted between the swingable operation means and a main body of the range to make it possible that the swingable operation means is returned to its initial position where it is still not engaging with the hook means, under the influence of the resilient force of the coil spring when the swingable operation means is disengaged from the hook means, and that a free end of the swingable operation means urges the engaging tab formed in the movable plate to move in a swinging manner through such return movement of the swingable operation means, so that a nail tab and the engaging tab both of which are formed in the movable plate are released from the notch groove and a stopper both of which are formed in the sliding plate, respectively, while the sliding plate is drawn back to a switch box side of the range by the resilient force of a spring mounted between the movable plate and the sliding plate whereby the circuit of the third power-supply circuit control mechanism is opened.

Any constituent element of the power-supply circuit control unit of the electronic range of the present invention may be made of conventional materials by the use of publicly known means.

BRIEF DESCRIPTION OF THE DRAWINGS

FIGS. 2 and 3 are longitudianl sectional views of the switch box of the power-supply circuit control unit of the electronic range of the present invention, wherein: FIG. 2 shows a condition in which the hook means are engaged; and FIG. 3 shows another condition in which the hook means are disengaged;

DESCRIPTION OF THE PREFERRED EMBODIMENT

Figure 1:
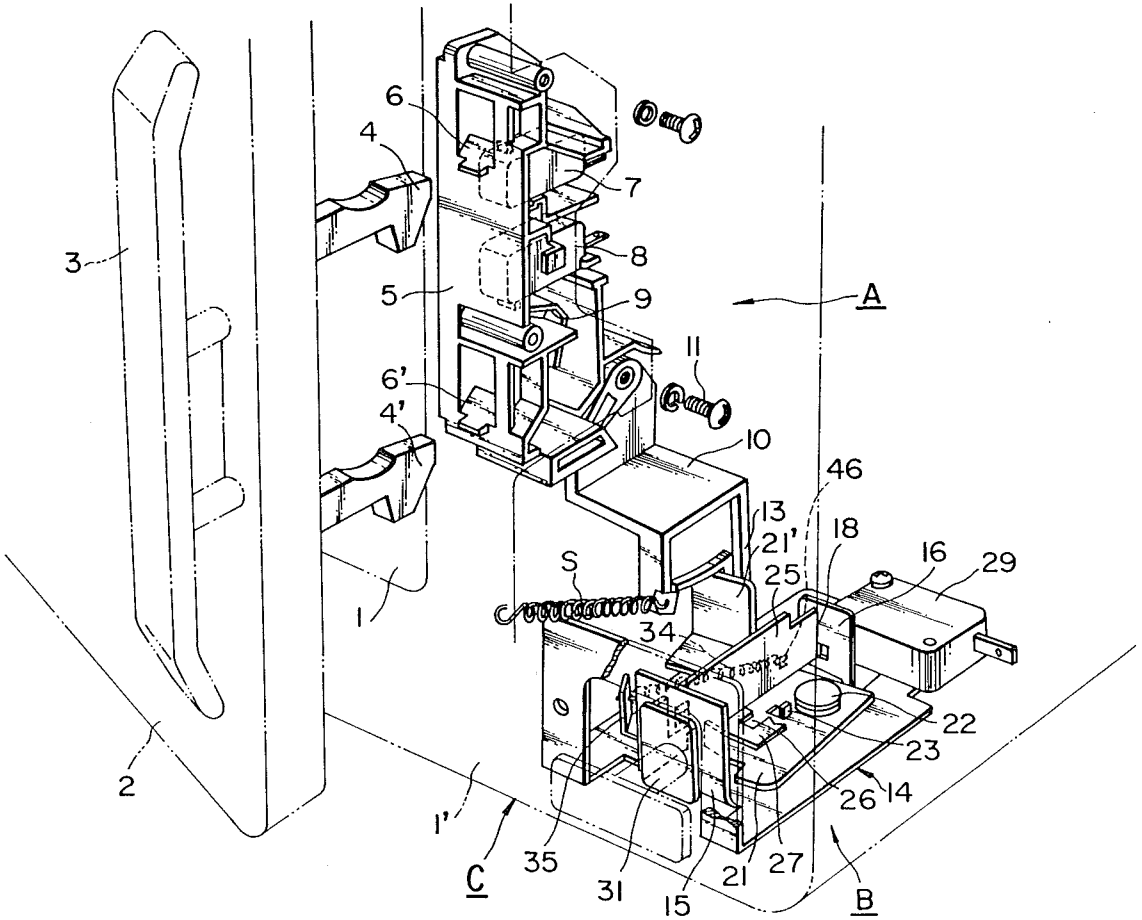
FIG. 1 is a partial perspective view of the electronic range of the present invention.

FIG. 1 is a perspective view of an embodiment of a power-supply circuit control unit of an electronic range of the present invention, wherein: the reference character "A" denotes a first and a second power-supply circuit control mechanisms provided with microswitches 7 and 8; and B a third power-supply circuit control mechanism provided with a microswitch 29. The reference numeral 1 shown in phantom lines denotes a main body of the electronic range; 1 a heating cage; 2 a range door fitted to the main body 1 through a hinge means (not shown) to cover a front opening portion of the main body 1; 3 a door handle of the range door 2, which handle 3 is fitted to an outer surface of the door 2 at a position opposite to its edge portion where the hinge means are fitted to; 4, 4' a pair of hook means which are vertically spaced apart from each other by a suitable distance and provided in a backside of the door 2 with respect to the handle 3 so as to be connected with each other through an interlock-arm (not shown) provided inside the door 2 to cooperate with each other. Such cooperating mechanism of the above interlock-arm may be a conventional one and therefore will not be described herein.

The reference numeral 5 denotes a switch box which is made of an insulating material and fixed to a peripheral edge portion of the heating cage 1' of the main body 1 in an embedding manner; and 6, 6' hook stopping tabs which are obliquely formed in opening portions provided in an upper and lower parts of the switch box 5 and integrally formed with the switch box 5. As is most clearly shown in FIG. 2, such opening portions are spaced apart from each other by the same distance as that between the hook means 4, 4' to make it possible that the hook means 4, 4' are inserted simultaneously into these opening portions.

Figure 2:
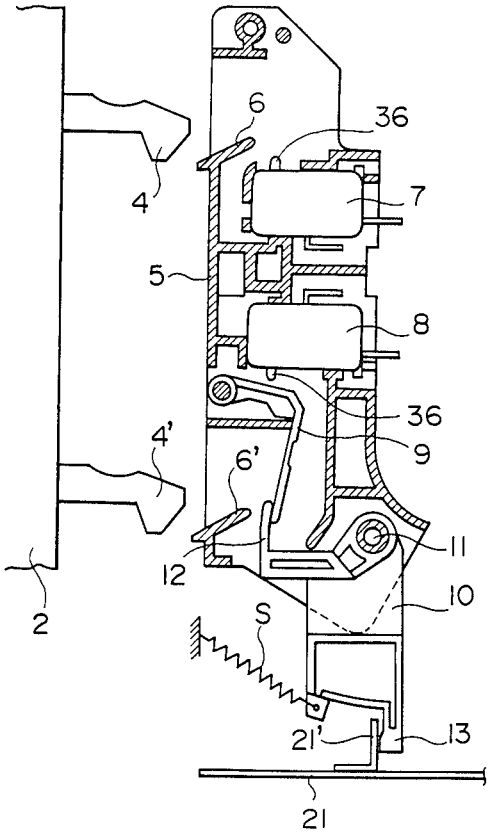
Figure 3:
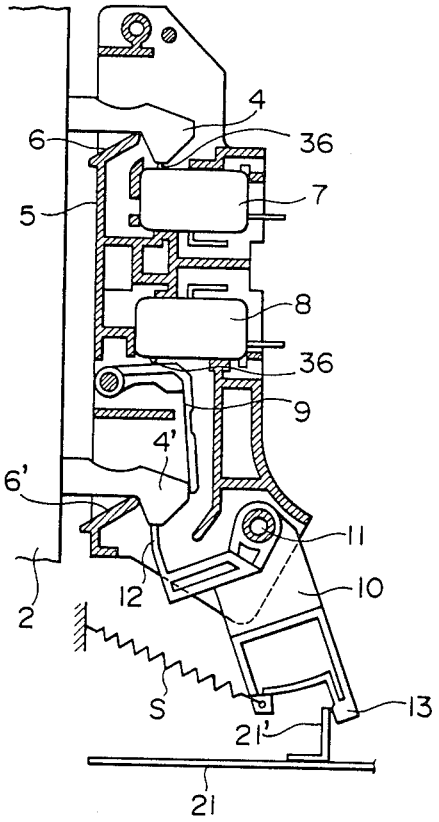

The microswitches 7, 8 are received in the switch box 5 and provided between such opening portions The microswitch 7 engages directly with the hook means 4 so as to be switched on and off, while the other microswitch 8 engages indirectly with the hook means 4' through a swinging member 9 which is pivotally supported between the microswitch 8 and the lower opening portion, to make it possible that the microswitch 8 is switched on and off. As shown in FIGS. 2 and 3, these microswitches 7, 8 are switched off when the range door 2 is opened, i.e., when the hook means 4, 4' are not inserted in the opening portions and not engaged with the hook stopping tabs 6, 6', respectively. The lower microswitch 8 is switched on through the swinging member 9 when the hook means 4' engages with the hook stopping tab 6' so that the circuit is closed. The upper microswitch 7 is directly switched on when the hook means engages with the hook stopping tab 4 so that the circuit is closed.

A swingable operation member 10 made of an insulating material is pivotally supported in a lower cavity of the switch box 5 through a screw 11, which operation member 10 is provided with a L-shaped arm 12 in its upper end in a projecting manner to make it possible that the arm 12 engages with a lower end of the swinging member 9 and the hook means 4' separately. Between a front lower end of the swingable operation member 10 and the heating cage 1' of the main body 1 of the electronic range is mounted a spring S which urges the swingable operation member 10 to swing the same 10 clockwise under the influence of its resilient force as shown in FIG. 2. The swingable operation member 10 is provided with a projection 13 in a rear side portion of its free end.

This swingable operation member 10 operatively connects the first and the second power-supply circuit control mechanisms "A" with the third power-supply circuit control mechanism B so as to associate the former mechanisms "A" and the latter mechanism B.

Under the swingable operation member 10 are provided the third power-supply circuit control mechanism B comprising a microswitch 29 and a unit C for operate the same 29.

Figure 4:
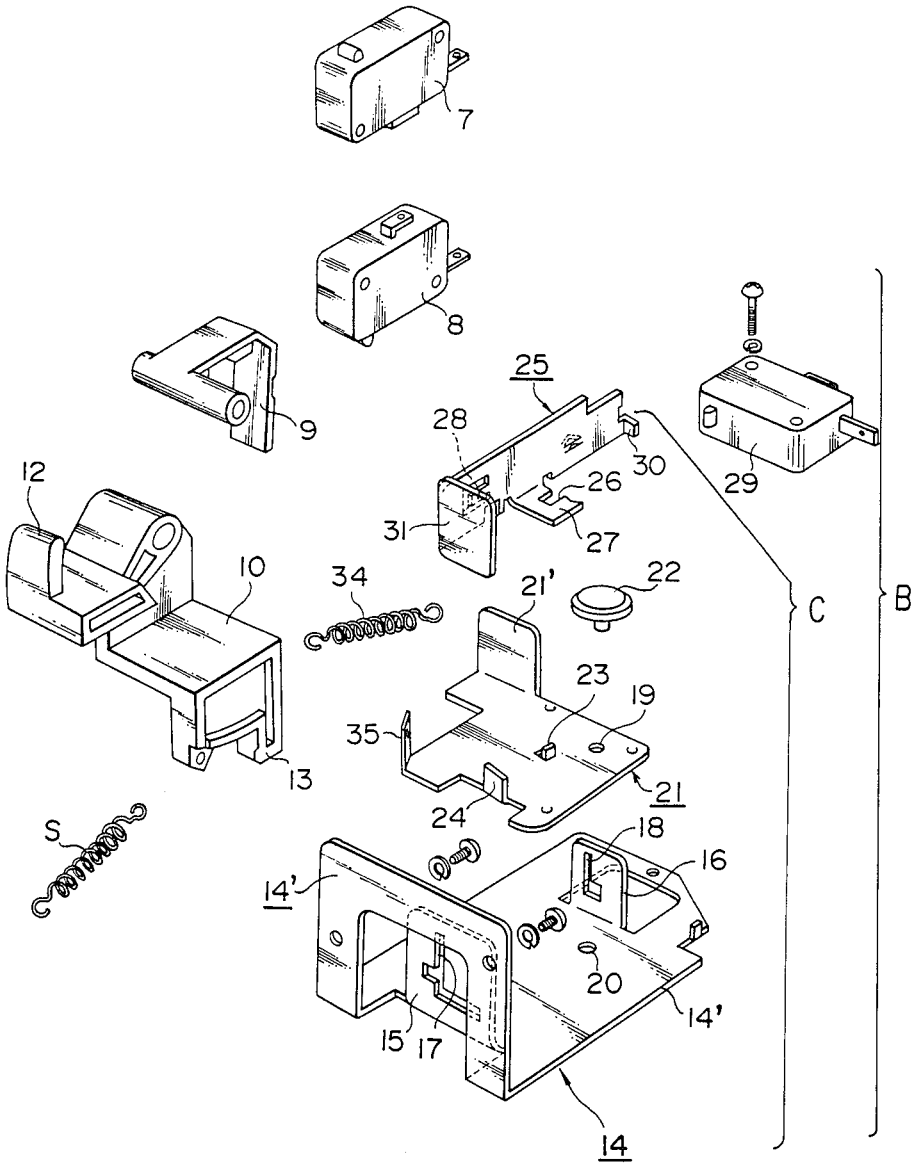
FIG. 4 is an exploded enlarged perspective view of the power-supply circuit control unit of the elecronic range of the present invention.

The unit C is shown in its exploded view in FIG. 4, wherein: the reference numeral 14 denotes a frame comprising a substantially L-shaped bent base portion 14' and a vertical upright portion 14" which has a reversed U-shape to make it possible that the frame 14, i.e., the third power-supply circuit control mechanism B is mounted inside the panel which is provided in a right side portion of the range door 2 of the main body 1, as a whole.

In the base portion 14' of the frame 14 are provided in a projecting manner a pair of vertical upright tabs 15, 16 which are spaced apart from each other in parallel to each other by a predetermined distance, and have substantially L-shaped sliding grooves 17, 18, respectively, between which upright tabs 15, 16 an aperture 20 is provided at a suitable position in a piercing manner.

On the other hand, a movable plate 21 is swingably mounted on the frame 14 through a pin 22 inserted into an aperture 19 of the movable plate 21 and the aperture 20, between the above upright tabs 15, 16, which plate 21 has a substantially square shape and comprises: a nail tab 23 in its substantially central position; an upright engaging tab 24 in a position near its one corner in a projecting manner; a coil spring engaging tab 35 in its another corner in a projecting manner; an operation tab 21' in its corner on a diagonal line passing through the corner near the engaging tab 24, in a projecting manner, so as to be opposite to the coil spring engaging tab 35; and the aperture 19 in a corner on the other diagonal line passing through the corner near the coil spring engaging tab 35.

The reference numeral 25 denotes a sliding plate having a substantially L-shape, and being mounted on an upper surface of the movable plate 21 which is mounted between the pair of the upright tabs 15, 16 of the frame 14, to make it possible to insert the sliding plate 25 into the sliding grooves 17, 18 which are provided in the upright tabs 15, 16, respectively. The sliding plate 25 comprises: a stopper 27 in a substantially central portion of a longitudinal and lower side portion thereof, which stopper 27 is provided with a notch groove 26 engaging with the nail tab 23 provided in the movable plate 21; an engaging groove 28 which engages with the engaging tab 24 formed in an end portion of the movable plate 21, in a detachable manner; and a pushing projection 30 which is formed by bending a longitudinal end thereof so as to operate the microswitch 29 fitted to the frame 14 in a switching on/off manner.

Figure 5:
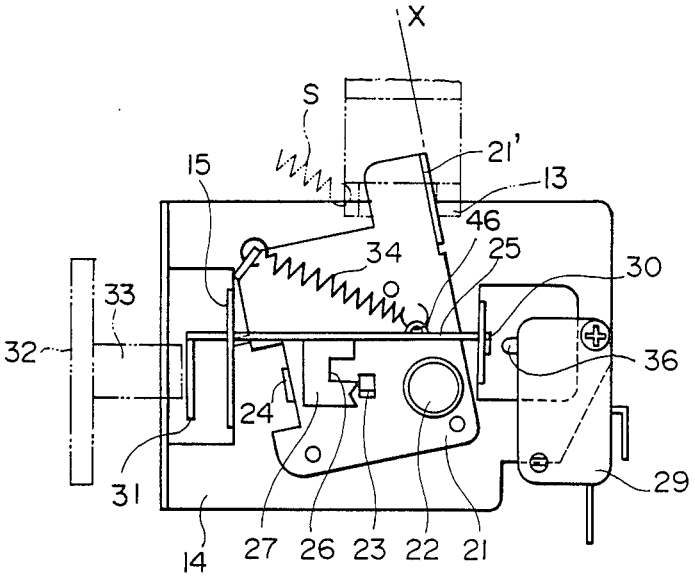
FIG. 5 is a longitudinal sectional view of an essential part of the third power-supply circuit control mechanism in a condition in which the range door is opened.
Figure 6:
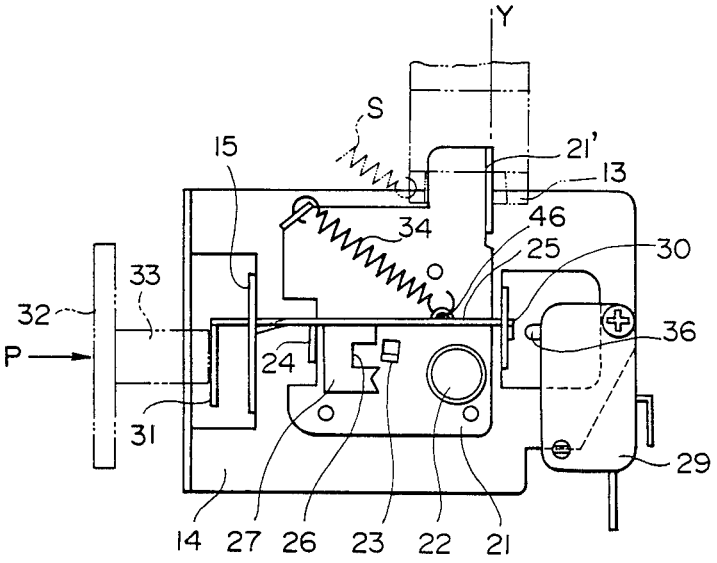
FIG. 6 is a longitudinal sectional view of the essential part of the third power-supply circuit control mechanism in another condition in which the range door is closed.
Figure 7:
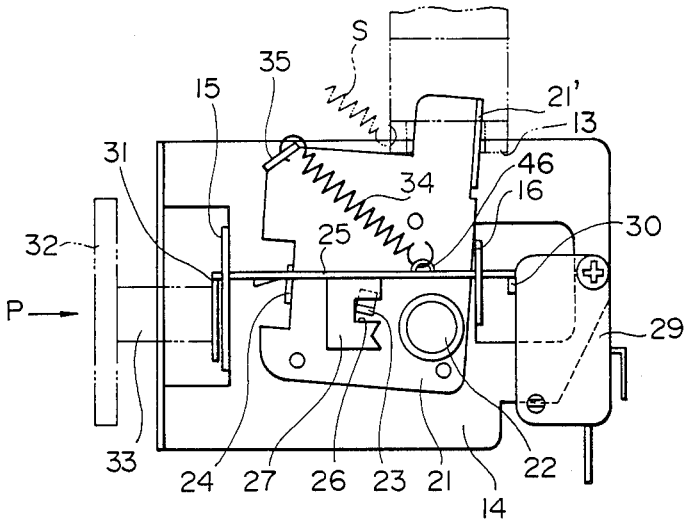
FIG. 7 is a longitudinal sectional view of the essential part of the third power-supply circuit control mechanism in further another condition in which the circuit of the third power-supply circuit control mechanism is closed.

On the other hand, the other longitudinal end of the sliding plate 25 is bent to be formed into a bent portion 31 so as to abut against an end surface of a shaft portion 33 of the push-button 32, which is shown in phantom lines in FIGS. 5, 6 and 7, when the push-button 32 is pushed.

The reference numeral 34 denotes a coil spring mounted between the hook portion 46 provided in a position near a right end portion of the sliding plate 25 and the coil spring engaging tab 35 formed in the corner of the movable plate 21, so as to urge the movable plate 21 positioned in X-position in FIG. 5 toward Y-position in FIG. 6.

Now, operation of the power-supply circuit control unit of the present invention will be hereinbelow described with reference to FIGS. 5, 6 and 7.

FIG. 5 shows a condition in which the range door 2 opposite to the opening portion of the heating cage 1' is open. In such condition, even when the pushbutton 32 is pushed, the sliding plate 25 can not be moved to the right in FIG. 5 to prevent the unit from being operated, since the sliding plate 25 slidably supported by the frame 14 has the stopper 27 which is formed in the substantially central lower side portion of the sliding plate 25 and prevents its notch groove 26 from engaging with the nail tab 23 which is formed in the substantially central portion of the movable plate 21.

When the range door 2 is closed, as shown in FIG. 3, the upper and the lower hook means 4 and 4' both of which are provided in the door 2 are inserted in the opening portions of the switch box 5 and engage with the hook stopping tabs 6 and 6', respectively, so that the upper hook means 4 switches on the microswitch 7 in the circuit while the lower hook means 4' pushes the swinging member 9 through which the microswitch 8 in the circuit is closed and the arm 12 of the swingable operation member 10 pivotally supported in the switch box 5 is pushed downward, whereby the swingable operation member 10 is swung counterclockwise against the resilient force of the spring S mounted between the main body 1 and the swingable operation member 10. As a result, the movable plate 21 is released from the free end 13 of the sliding plate 25 and swung clockwise about the pin 22 from the X-position in FIG. 5 to the Y-position in FIG. 6 under the influence of the resilient force of the spring 34. When the movable plate 21 reaches the position shown in FIG. 6, the nail tab 23 moves into a position opposite to a central portion of the notch groove 26 provided in the stopper 27 of the sliding plate 25.

In such condition, when the push-button 32 is pushed in a direction P shown by an arrow in FIG. 6, the shaft portion 33 of the push-button 32 abuts against the bent portion 31 of the sliding plate 25 to move the same 25 to the right so that the notch groove 26 of the sliding plate 25 is moved toward the nail tab 23 of the movable plate 21 while the pushing projection 30 provided in the other end of the sliding plate 25 pushes an opening/closing element 36 of the microswitch 29 to close the same 29. After completion of such operation, even when the push-button 32 subjected to its pushing action is released from such pushing action, the sliding plate 25 is prevented from returning to its initial position toward the push-button 32 so that the unit is kept in its energized condition, since the engaging groove 28 of the sliding plate 25 is already engaged with the engaging tab 24 of the movable plate 21 as shown in FIG. 7.

On the other hand, after the main circuit is opened upon its energizing time predetermined by a timer (not shown) is over, when the range door 2 is opened, the hook means 4, 4' provided in the door 2 are released from the hook stopping tabs 6, 6' in the opening portions of the switch box 5 provided in the main body 1, respectively, while the upper and the lower microswitches 7, 8 received in the switch box 5 are opened, respectively, and the swinging member 9 pivotally supported at its one end in the switch box 5 returns to its initial position shown in FIG. 2, and further the swingable operation member 10 is also drawn back clockwise to its initial position shown in FIG. 2 by the resilient force of the spring S, so that the operation tab 21' of the movable plate 21 is pushed by the projection 13 provided in the free end of the swingable operation member 10 so as to be drawn back to its position shown in FIG. 5 to make it possible that the engaging tab 24 of the movable plate 21 is pulled back the engaging groove 28 of the sliding plate 25. As a result, the sliding plate 25 having been restricted in its sliding action slides to the left in FIG. 5 under the influence if the resilient force of the spring 34 so that the nail tab 23 of the movable plate 21 is released from the notch groove 26 of the stopper 27 and then the stopper 27 engages with the engaging tab 24 of the movable plate 21 again.

Consequently, in a condition in which the range door 2 is open, even if the user pushes the push-button 32 by mistake, it is possible to prevent the unit from being energized.

Figure 8:
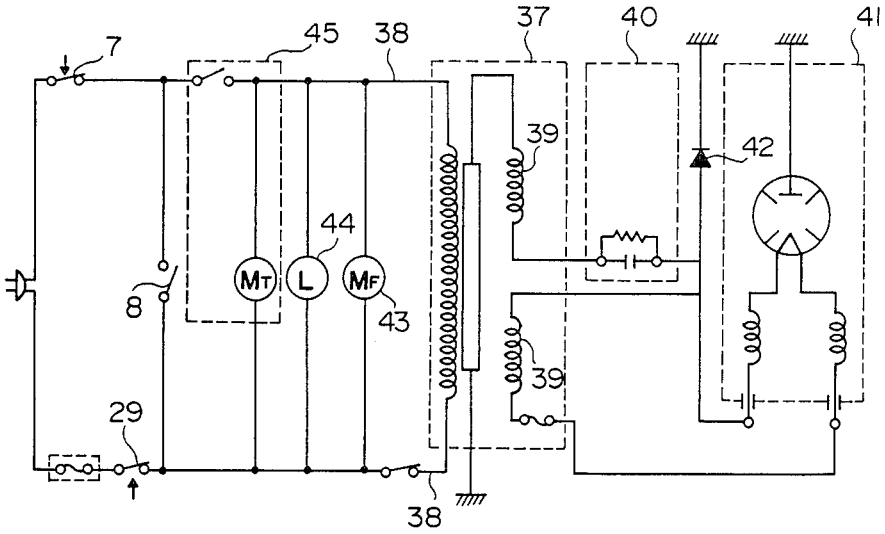
FIG. 8 is a schematic diagram of a typical electrical circuit of the electronic range of the present invention.
Figure 9:
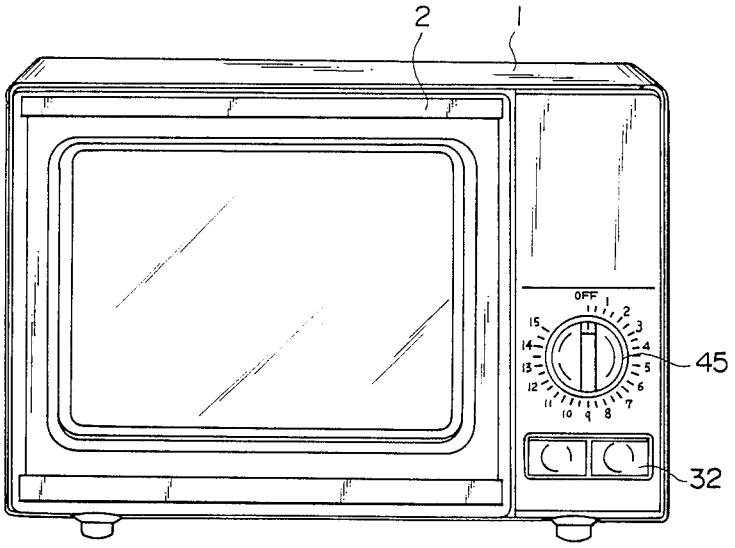
FIG. 9 is a perspective view of an example of a conventional electronic range.
Figure 10:
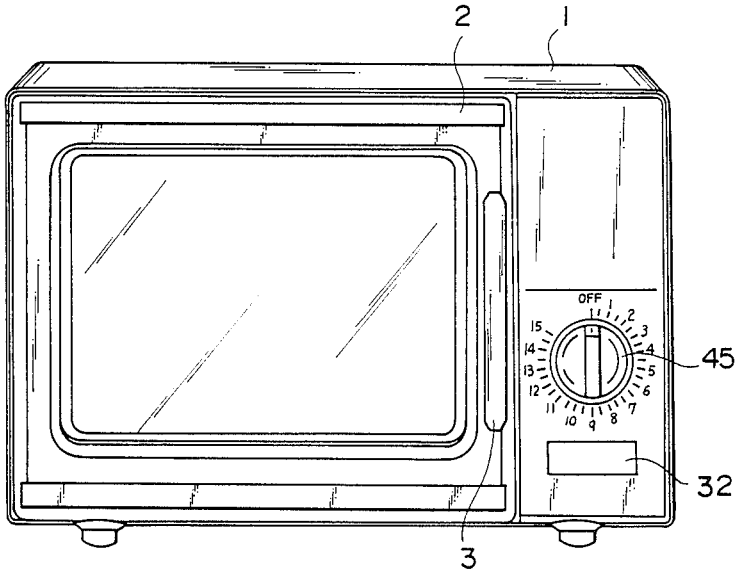
FIG. 10 is a perspective view of an embodiment of the electronic range of the present invention.

The above is the description as to the locking and releasing actions of the first and the second power-supply circuit control mechanisms and further the third power-supply circuit control mechanism. The following is a description of a typical electrical circuit of the electronic range provided with the power-supply circuit control unit according to the present invention with reference to the schematic diagram in FIG. 8.

The reference numeral 37 denotes a high-tension power-supply transformer; 38 an AC 100 V power source connected to a primary winding of the high-tension power-supply transformer 37; 39 a secondary winding of the high-tension power-supply transformer 37; 40 a high-tension condenser; 41 a magnetron oscillator; 42 a diode connected between the secondary winding 39 of the high-tension power-supply transformer 37 and the ground; 43 a cooling fan motor; 44 a cabinet light for illuminating a cabinet of the heating cage 1' and for confirming energizing of the unit; and 45 a timer for setting a cooking according to various foods to be cooked, which timer 45 switches off the AC 100 V power-supply when the thus set predetermined time is over.

In the electronic range of the present invention, the range door of the power-supply circuit control unit thereof is exclusively manually opened and closed, and, in case that the range door is open, the microswitch 29 which is a main oscillation stopping equipment for closing a negative line of the power source is prevented from being operated even if the push-button 32 is pushed. In case that the range door 2 is manually closed in a normal manner, at the same time a microswitch which is a main oscillation stopping equipment in a positive line and a monitor-switch for confirming a condition of the circuit are operated in an interlocking manner to close the circuit. After that, a microswitch for closing a negative side circuit is switched on by pushing the push-button so as to energize the entire circuit. When the predetermined set time for cooking is over, the timer opens the circuit to make it possible to manually open the range door, so that there is no fear to misuse the switch. Therefore, in the electronic range of the present invention, in comparison with the conventional electronic range, operation for use thereof is simple while an interior construction of the main body thereof is neat, to make it possible to increase the workability in assembling of parts in manufacturing thereof and also make it possible to scale its size.

What is claimed is:

1. An electronic range characterized by manually conducting an opening/closing operation of a range door thereof and provided with a power-supply circuit control unit comprising:

a pair of interlocked hook means which are provided inside said range door;

a pair of first and a second power-supply circuit control mechanism operationally associated with and actuated by said hook means responsive to said opening/closing operation of said range door, one of which mechanisms engages with one of said hook means to conduct a direct opening/closing operation of its circuit, while the other mechanism engages indirectly with the other hook means through a swinging means to conduct an opening/-closing operation of its circuit;

a third power-supply circuit control mechanism capable of being energized only when manually operated;

a swingable operation means associated with both said swinging means and a third power-supply circuit control mechanism and provided with an arm in the upper end of said swingable operation means and an engaging portion in the lower end of said swingable operation means, which arm engages with a free end of the swinging means in a detachable manner, and which engaging portion engages with a portion of said third power-supply circuit control mechanism;

said swinging means being permitted its gravitational return to its initial position where it is still not engaging with said hook means, when it is disengaged from said hook means;

said swingable operation means being urged in a predetermined direction under the influence of a resilient force of a coil spring so as to return to a position where said third power-supply circuit control mechanism is locked; and said third power-supply circuit control mechanism comprising a frame mounted on an inner surface of a switch panel fitted to a front surface of a heating cage, a sliding plate slidably inserted in grooves formed in a pair of upright tables of said frame and a movable plate pivotally mounted on said frame, said sliding plate being slidably moved through a push-button which is inserted in said switch panel in a projectable/retractable manner to make possible that said sliding plate engages at a notch groove formed in its bent tab with an engaging tab provided in said movable plate in a projectable manner, while said sliding plate abuts against said push-button, against a microswitch provided in said third power-supply circuit control mechanism to operate the same.

2. The electronic range as set forth in claim 1 wherein: a coil spring is mounted between said swingable operation means and a main body of said range to make it possible that said swingable operation means is returned to its initial position where it is still not engaging with said hook means, under the influence of the resilient force of said coil spring when said swingable operation means is disengaged from said hook means, and that a free end of said swingable operation means urges said engaging tab formed in said movable plate to move in a swinging manner through such movement of said swingable operation means, so that a nail tab and said engaging tab both of which are formed in said movable plate are released from said notch groove and a stopper both of which are formed in said sliding plate, respectively, while said sliding plate is drawn back to a switch box side of said range by the resilient force of a spring mounted between said movable plate and said sliding plate, whereby the circuit of said third power-supply circuit control mechanism is opened.

* * * * *